US006099229A

United States Patent [19]

Knoch

[11] Patent Number: 6,099,229

[45] Date of Patent: Aug. 8, 2000

[54] COAL CHARGING CAR FOR CHARGING CHAMBERS IN A COKE-OVEN BATTERY

[75] Inventor: Ralf Knoch, Gelsenkirchen, Germany

[73] Assignee: Thyssen Krupp Encoke GmbH, Bochum, Germany

[21] Appl. No.: 09/159,487

[22] Filed: Sep. 23, 1998

[30] Foreign Application Priority Data

Sep. 23, 1997 [DE] Germany ..... 197 41 875
Oct. 4, 1997 [DE] Germany ..... 197 43 868

[51] Int. Cl.[7] ..... C10B 31/04

[52] U.S. Cl. ..... 414/164; 414/188; 414/190; 414/199; 202/241

[58] Field of Search ..... 414/397, 518, 414/502, 147, 150, 152, 154, 158, 526, 160, 162, 163, 164, 167, 172, 173, 179, 187, 188, 190, 199, 684.3; 432/239; 202/251, 262, 241

[56] References Cited

U.S. PATENT DOCUMENTS

| | | | |
|---|---|---|---|
| 3,142,391 | 7/1964 | Tweit | 414/164 |
| 4,066,175 | 1/1978 | Schulte | 414/163 X |
| 4,151,919 | 5/1979 | Blase et al. | 414/164 |
| 4,708,571 | 11/1987 | Sappok | 414/199 X |
| 5,384,015 | 1/1995 | Schröter et al. | 414/199 X |
| 5,941,445 | 8/1999 | Nestler | 414/160 X |

FOREIGN PATENT DOCUMENTS

| | | |
|---|---|---|
| 25 45 265 | 4/1977 | Germany . |
| 29 22 571 C2 | 12/1980 | Germany . |

*Primary Examiner*—Frank E. Werner
*Attorney, Agent, or Firm*—Herbert Dubno

[57] ABSTRACT

A coal charging car for a coke-oven battery has a screw-type feeder beneath the coal hopper shiftable on the chassis of the car to allow positioning of the outlet of that feeder over the hole communicating with the coking chamber without moving the car.

8 Claims, 6 Drawing Sheets

COAL CHARGING CAR FOR CHARGING CHAMBERS IN A COKE-OVEN BATTERY

FIELD OF THE INVENTION

The present invention relates to a coal charging car for charging chambers in a coke-oven battery.

BACKGROUND OF THE INVENTION

A conventional coal charging car for a coke-oven battery can have a funnel shaped discharge outlet, a horizontal screw-type feeder underneath said outlet, and a lid-lifting device for opening and closing the lids of the chamber charging holes. The screw-type feeder can have a housing which can be charged from above and which has an outlet nozzle on its underside, at least one rotary feed screw inside the housing and a flange-mounted screw drive mechanism. A telescopic pipe is attached to the outlet nozzle to connect the latter to an open charging hole.

The coal charging car travels on rails along the roof of the chambers of a coke-oven battery. It picks up coal batches from a coal tower and transports them to the chambers which are filled via the charging holes.

Modern coal charging cars have a forced-feed charging system with a horizontal screw-type feeder under the discharge outlet. They are also equipped with an automatic lid-lifting device for opening and closing the charging hole lids as well as with a telescopic pipe which connects the outlet nozzle with the open charging hole to prevent interfering emissions during the charging operation.

The equipment described demands that substantial height be available for the installation of the screw-type feeder on the underside of the coal charging car. The local conditions in existing coke-oven plants do not always allow for the use of modern coal charging cars with the equipment described.

OBJECTS OF THE INVENTION

It is an object of the present invention to provide a coal charging car which has low height requirements for the screw-type feeder and the lid-lifting device.

Another object of this invention is to provide a coal charging car for a coke oven-battery which represents in advance over the art as far as positioning of the discharge outlet with respect to the filling hole is concerned.

Still another object of this invention is to provide an improved charging car for the purposes described which is free from drawbacks of earlier coke-oven charging systems.

SUMMARY OF THE INVENTION

To achieve this, the invention provides that the housing of the screw-type feeder, which moves horizontally, is attached to the underside of the coal charging car. When the position of the charging car remains unaltered, the housing can be moved via a positioning device, e.g. a servomotor which can be a fluid-operated cylinder, between its starting position, in which the outlet nozzle is positioned to the side of the charging hole, and its charging position, in which the charging nozzle is essentially aligned with the charging hole.

In one arrangement which is preferred in practice, the screw-type feeder is aligned in the direction of motion of the coal charging car, i.e. the screw follows an axial motion aligned in the direction of motion of the coal charging car, i.e. the screw follows an axial motion in a longitudinal direction. The travelling distance of the screw-type feeder is such that when the feeder is in its working position (starting position) the charging hole lid is freely accessible to the lid-lifting device, and when the feeder is in its second working position (charging position) the outlet nozzle is essentially aligned with the charging hole, provided that the location of the coal charging car remains unaltered. The arrangement of the invention enables the outlet nozzle to be arranged so that the telescopic pipe must only bridge a small distance during the charging operation. Consequently, the length of the telescopic pipe can be kept to a minimum and any additional machinery required for the operation of the telescopic pipe can thus also be very compact.

More particularly, the aforestated objects are achieved in a coal charging car for a coke-oven battery which comprises:

- a chassis displaceable along a path for successively positioning the car at successive charging holes of chambers of the coke-oven battery;
- a bin on the chassis having a funnel-shaped outlet for coal to be discharged into the chambers;
- a horizontal screw-type feeder below the bin on the chassis having a housing open upwardly to receive coal from the outlet, the housing being guided on the chassis for horizontal movement relative to the chassis, the housing having an outlet nozzle alignable with the holes for discharging coal into the holes;
- a telescoping pipe connected to the outlet nozzle for bridging between the outlet nozzle and the respective charging hole;
- a lid-lifting device on the chassis for lifting lids of the charging holes and replacing lids on the charging holes; and
- positioning means on the chassis engaged with the housing for shifting the feeder from a starting position wherein the outlet nozzle is offset to a side of a selected charging hole into a charging position wherein the outlet nozzle is substantially aligned with the selected charging hole without altering a position of the chassis with respect to the selected charging hole.

In another practical embodiment of the invention, the housing of the screw-type feeder, which is preferably trough-shaped, is equipped with a cover plate on its upper side which, when the screw-type feeder is in its starting position, closes the discharge outlet of the charging car to such an extent that coal cannot flow on to the roof of the chambers. Thus the cover on the screw-type feeder acts as a sliding plate which closes the discharge outlet of the coal charging car and only opens it when a chamber is being charged and when the screw-type feeder is in the appropriate charging position.

A further preferred embodiment of the invention provides for a shut-off device in the outlet nozzle of the screw-type feeder, e.g. in the form of a gate valve, which can be operated by a device attached to the screw-type feeder. An operating device is also arranged on the perimeter of the outlet nozzle and enables the telescopic pipe to be raised and lowered automatically.

The housing of the screw-type feeder is driven along rails which are arranged on both sides of the screw-type feeder's housing and supported by the steel carriage of the charging car. The rails can have any type of track profile.

The lid-lifting device has the usual grabbing and lifting equipment. A device must also be provided to extract the cover from the charging area. For this purpose, the lid-lifting device can be provided with a separate drive which performs a translational movement or a horizontal swivelling motion. In a preferred embodiment of the invention, the lid-lifting device runs along the rails attached to the steel carriage of the charging car. The rails run parallel to the guide rails of the screw-type feeder, the motion of the feeder along the guide rails and the motion of the lid-lifting devices along said rails being positively coupled. This rigid coupling permits lateral, relative motion between the screw-type feeder and the lid-lifting device during travel, the relative motion being controlled by the guide rails. A coupling rod with pivoted knuckles is used for this purpose. In this particular embodiment of the invention the travelling motion of the screw-type feeder, which is relative to the discharging outlet, is used to extract a charging hole lid picked up by the lid-lifting device, from the charging hole section and move it back to the charging hole once the charging operation has been completed. A preferred embodiment of the invention provides for a hydraulic or electromechanical adjusting device on the steel carriage of the coal charging car, said device working on a coupling beam attached to the housing of the screw-type feeder. The lid-lifting device is also connected to the coupling beam by a rod.

According to another feature of the invention a vertically adjustable device is provided for cleaning the charging hole lid and rim, the device being attached to the feeder housing at the same end as the outlet nozzle. This device can be moved horizontally with the housing between the latter's starting position and its charging position and can be deposited on the charging hole rim when the housing is in its starting position. In this particular embodiment of the invention, the lid-lifting device is not coupled with the travelling motion of the screw-type feeder and moves horizontally, independent of the horizontal travel of the feeder housing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
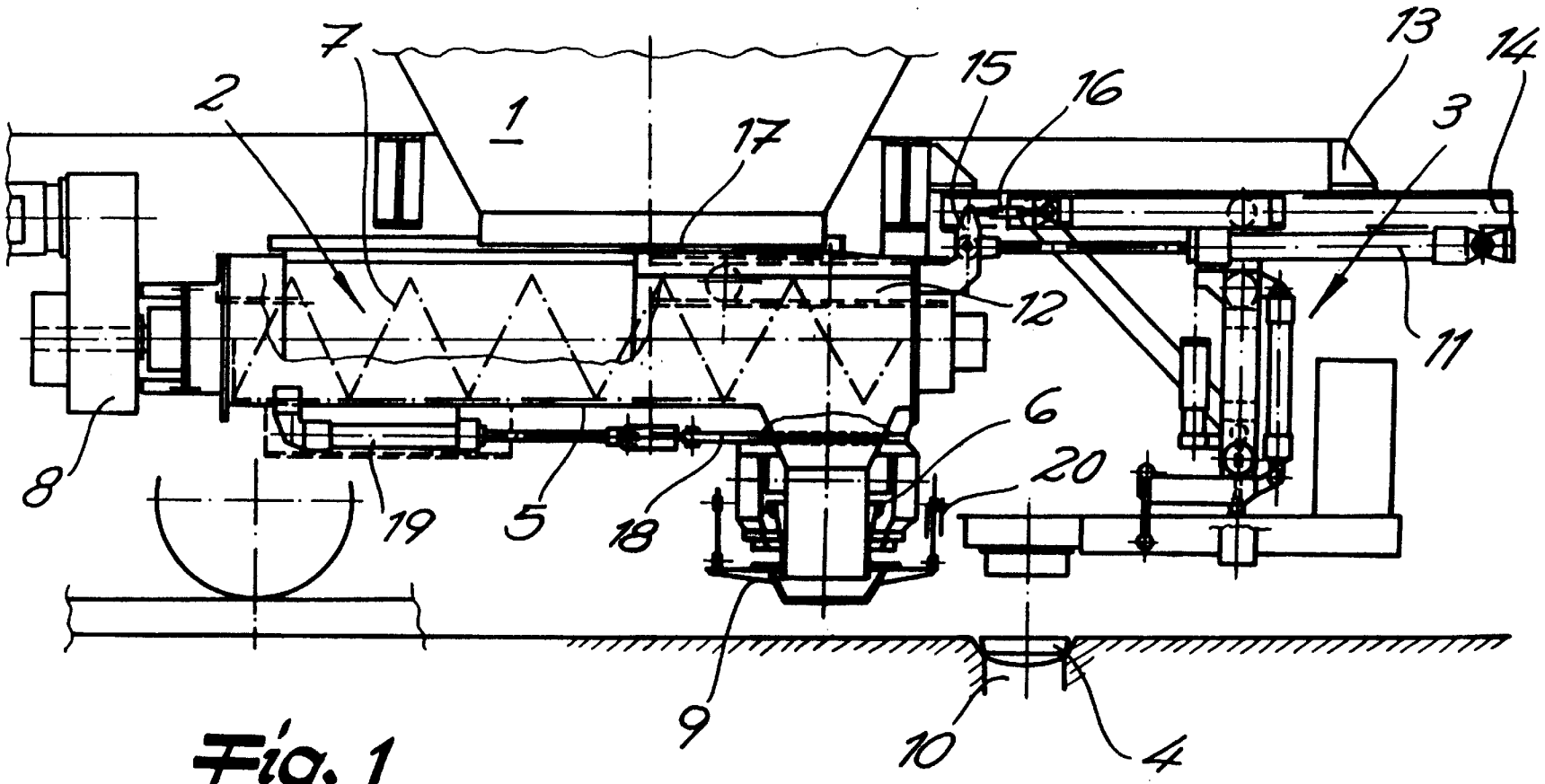
FIGS. 1 to 5 are longitudinal cross sectional views through the lower part of a coal charging car which is driven along rails on the roof of the coke oven of a battery in a coke oven plant.

The coal charging car of the invention picks up a coal batch from a coal tower and transports it to the chambers of the coke-oven battery. The coal is emptied into the chambers vertically via charging holes. The chassis 13 of the coal charging car shown in the diagrams has a funnel-shaped discharge outlet 1, a horizontal screw-type feeder 12 underneath the discharge outlet 1 and a lid-lifting device 3 for opening and closing the charging hold lids 4 of the coking chambers. The basic configuration of the screw-type feeder 2 comprises the housing 5, with a feed opening in the top and an outlet nozzle 6 at the bottom, at least one rotary feed screw 7 and a screw drive mechanism 8 flanged to the housing 5. A telescopic pipe 9 is attached to the outlet nozzle, the pipe connecting the outlet nozzle 6 and the open charging hole 10.

The housing 5 of the screw-type feeder 2 is positioned on the underside of the coal charging car such that it can travel in a horizontal direction. In addition, a servo-motor enables the feeder to travel between a starting position, in which the outlet nozzle is positioned to the side of the charging hole, and a charging position, in which the outlet nozzle 6 is aligned with the charging hole, 10 provided that the location of the charging car remains unaltered.

Figure 2:
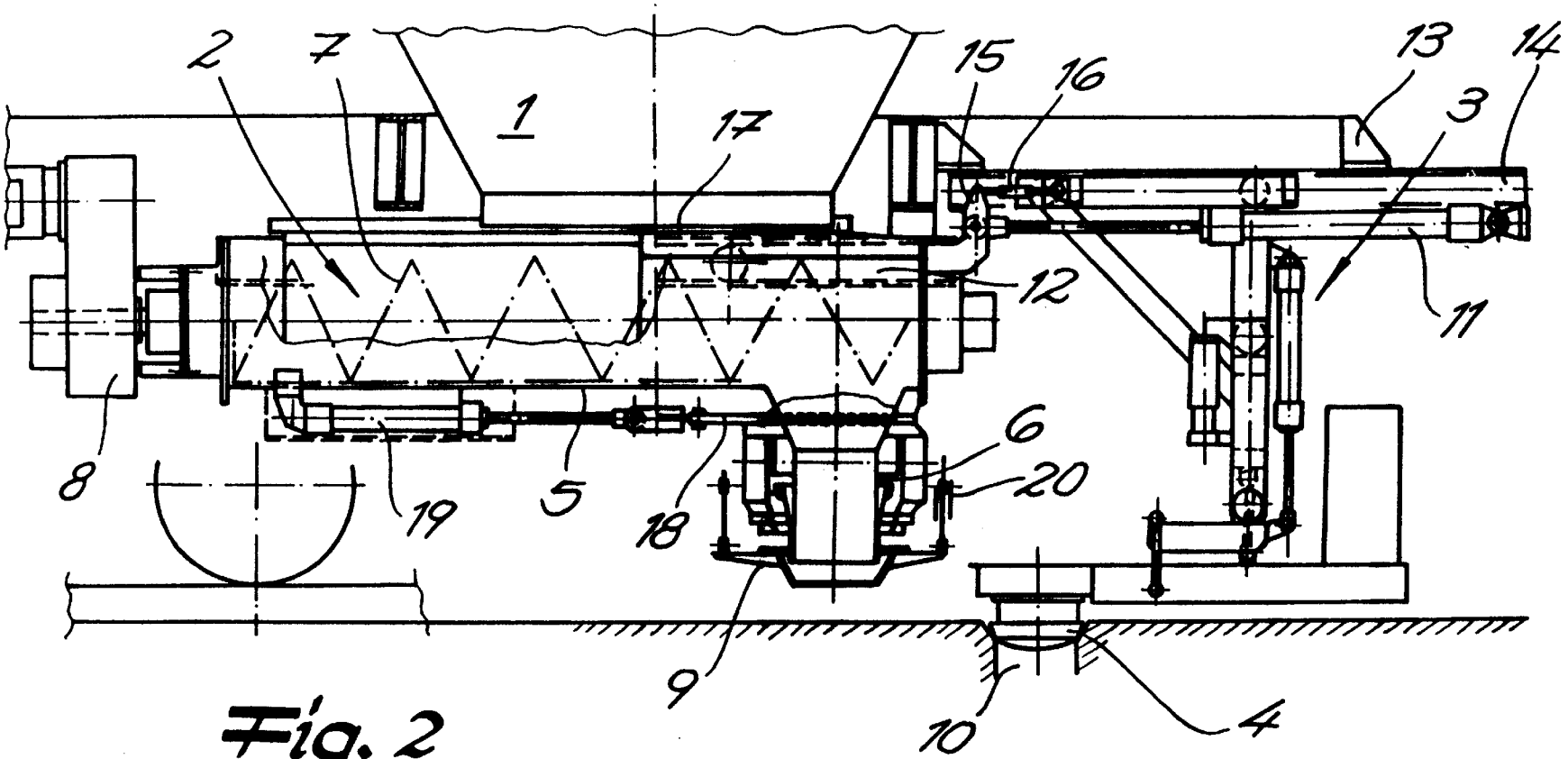
Figure 3:
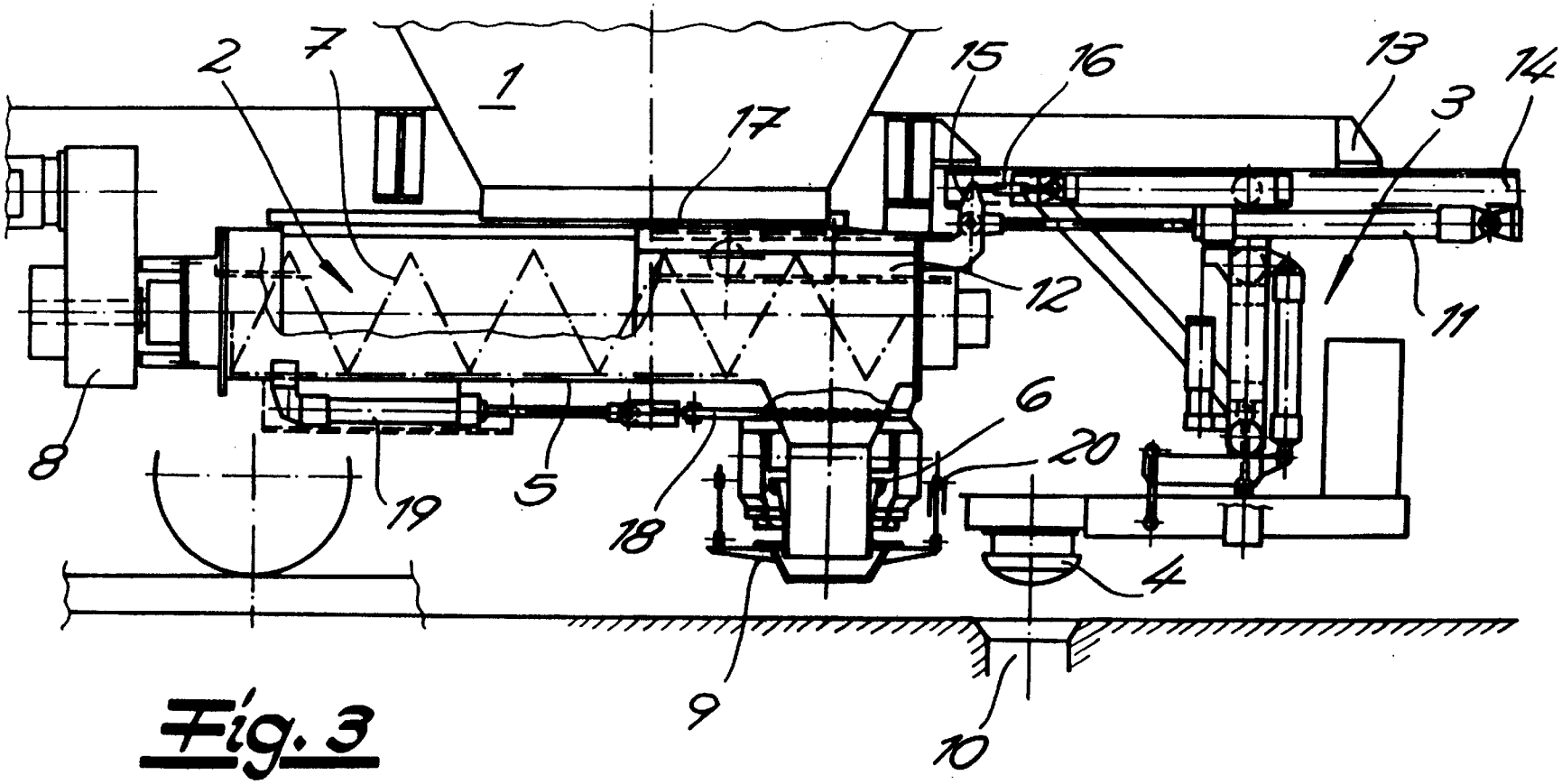
Figure 4:
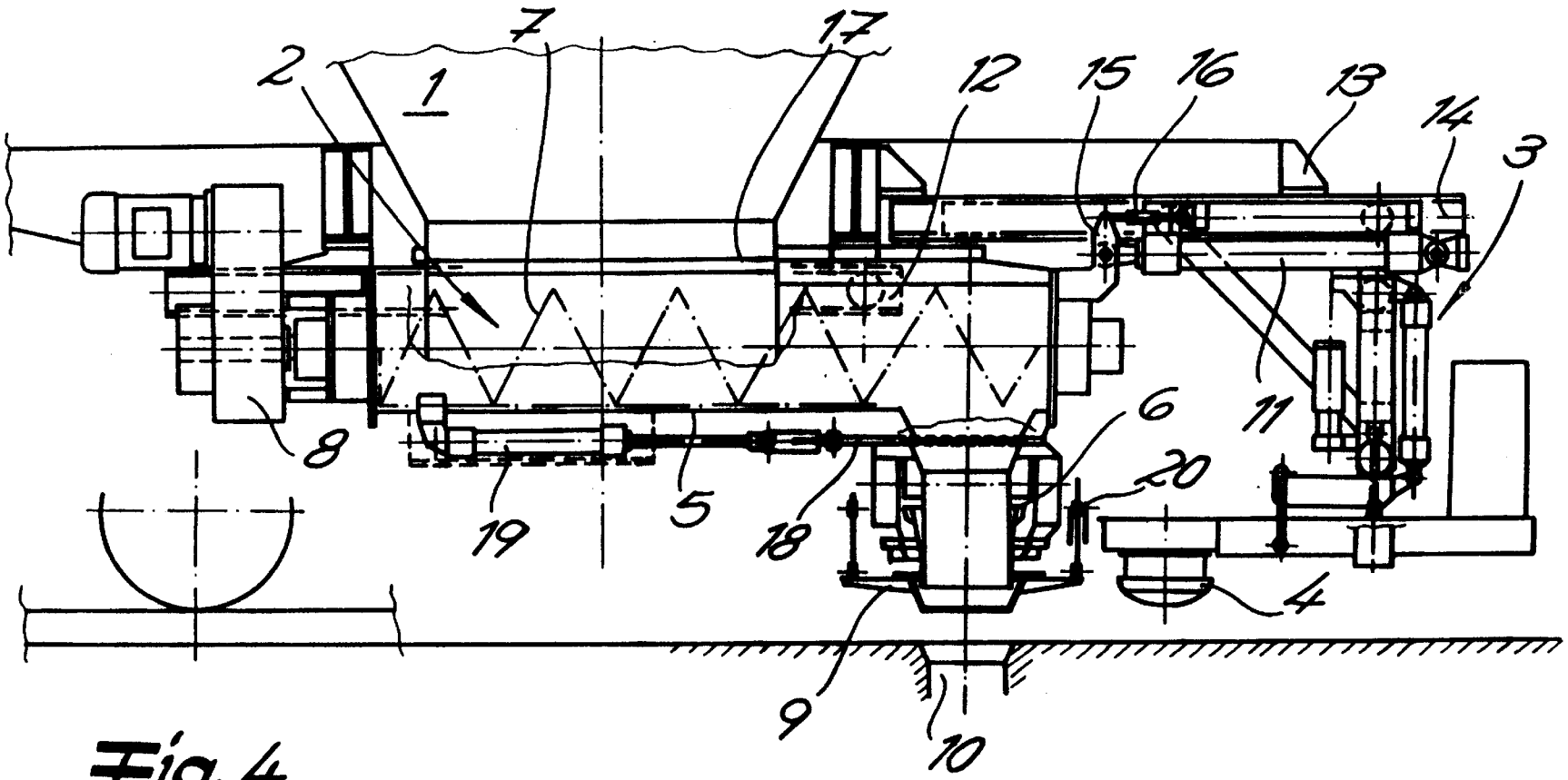
Figure 5:
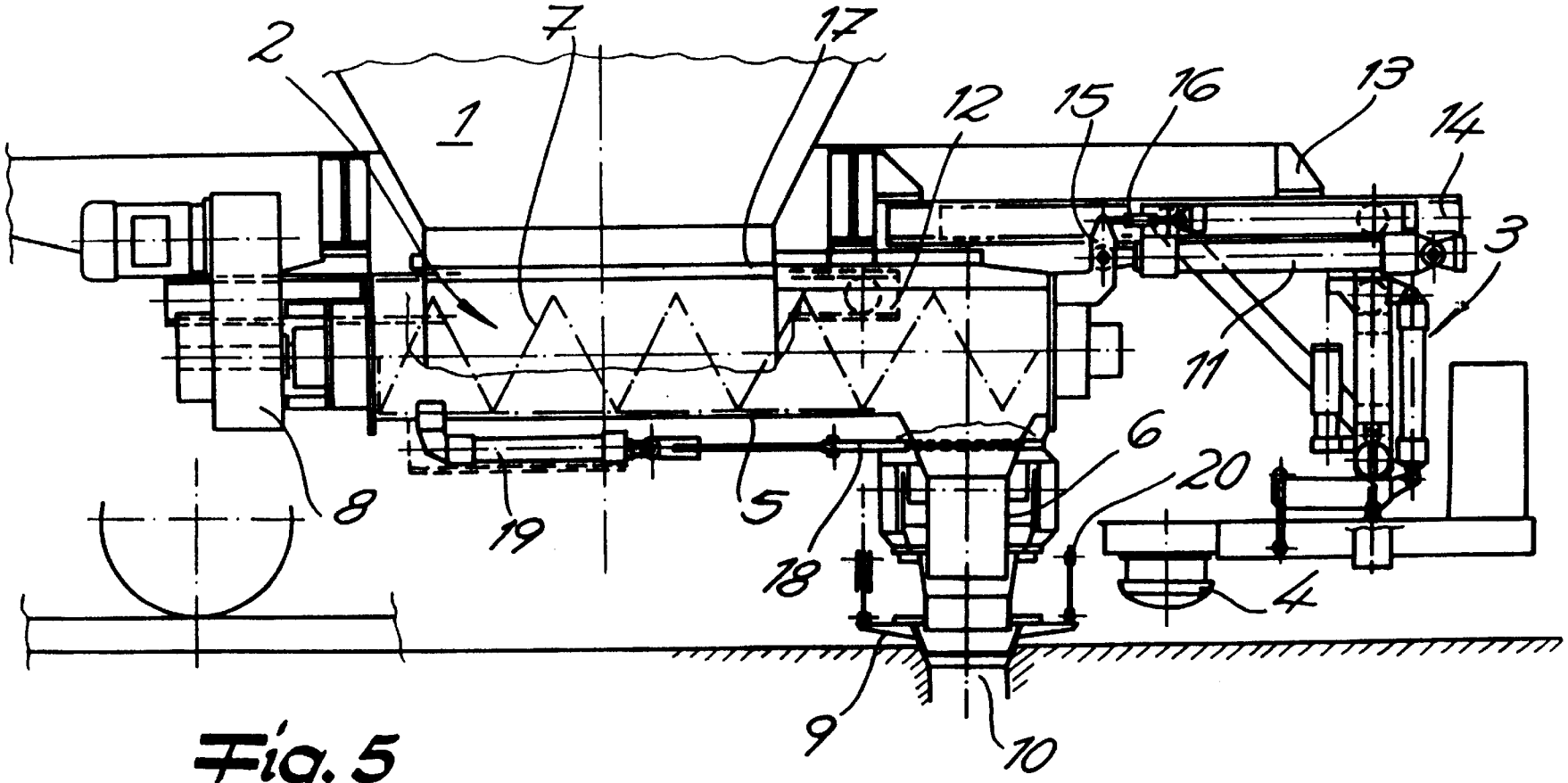

FIGS. 1 to 3 show the screw-type feeder in its starting position and FIGS. 4 to 5 in its charging position. The feeder's housing 5 travels along guide rails 12 which are positioned on both sides of the housing 5 on the steel carriage or chassis 13 of the coal charging car. The lid-lifting device 3 travels along rails 14 which are also positioned on the steel carriage 13 of the coal charging car. These rails 14 run parallel to those 12 of the screw-type feeder. Furthermore, upon closer inspection of the diagrams, it can be seen that the motion of the screw-type feeder 2 along its rails 12 and the motion of the lid-lifting device 3 along its rails are positively coupled. A hydraulic or electromechanical adjusting device 11 is provided to adjust the motion of the screw-type feeder 2, said device also being attached to the steel carriage 13 of the coal charging car. In the embodiment shown, the device works on a coupling beam 15 attached to the housing 5 of the screw-type feeder 2. The lid-lifting device is also attached to this coupling beam by means of a rod.

The housing 5 of the screw-type feeder 2 is equipped at the top with a cover plate 17 which partially or wholly closes the discharge outlet 1 when the screw-type feeder 2 is in its starting position. This arrangement prevents coal from leaking on to the roof of the coking chambers when the feeder is in its starting position.

A shut-off device, such as a gate valve 18, is arranged in the outlet nozzle of the screw-type feeder 2 and is operated by a device 19 attached to said feeder. An operating device 20 for the telescopic pipe 9 can also be seen positioned on the perimeter of the outlet nozzle 6. The operating device 20 permits the telescopic 9 to be raised and lowered automatically.

A comparison of the diagrams clearly shows the operation and function of the coal charging car in accordance with the invention. The coal charging car picks up the coal batch from a coal tower in a coke-oven plant and travels to a coking chamber where it is positioned on a charging hole 10 covered with a charging hole lid 4 (FIG. 1). At the same time, the housing 5 of the screw-type feeder 2 takes up its starting position as shown in FIG. 1. Once the coal charging car has been positioned on the coking chamber due to be filled, the charging hole lid is automatically lifted by the lid-lifting device 3. The grasping and lifting of the charging hole lid 4 is shown in FIGS. 2 and 3. It is evident that the area above the charging hold lid is freely accessible and that the screw type feeder 2, with its outlet nozzle 6 and telescopic pipe 9, does not restrict the manipulation of the lid-lifting device 3. Once the charging hole lid 4 has been lifted, the housing 5 of the screw-type feeder 2 and the lid-lifting device 3 are moved translationally in a common, horizontal motion. The travelling distance is such that the outlet nozzle 6 of the screw-type conveyor 2 takes up the charging position shown in FIG. 4 in which the outlet nozzle 6 is essentially in alignment with the charging hole 10. The telescopic pipe is then lowered and a connection is established between the outlet nozzle 6 and the charging hole 10. The gate valve 18 in the outlet nozzle 6 is then opened and the screw drive mechanism 8 is activated. This starts the coal filling operation in which coal is transported along the screw 7 into the coking chamber.

Figure 6:
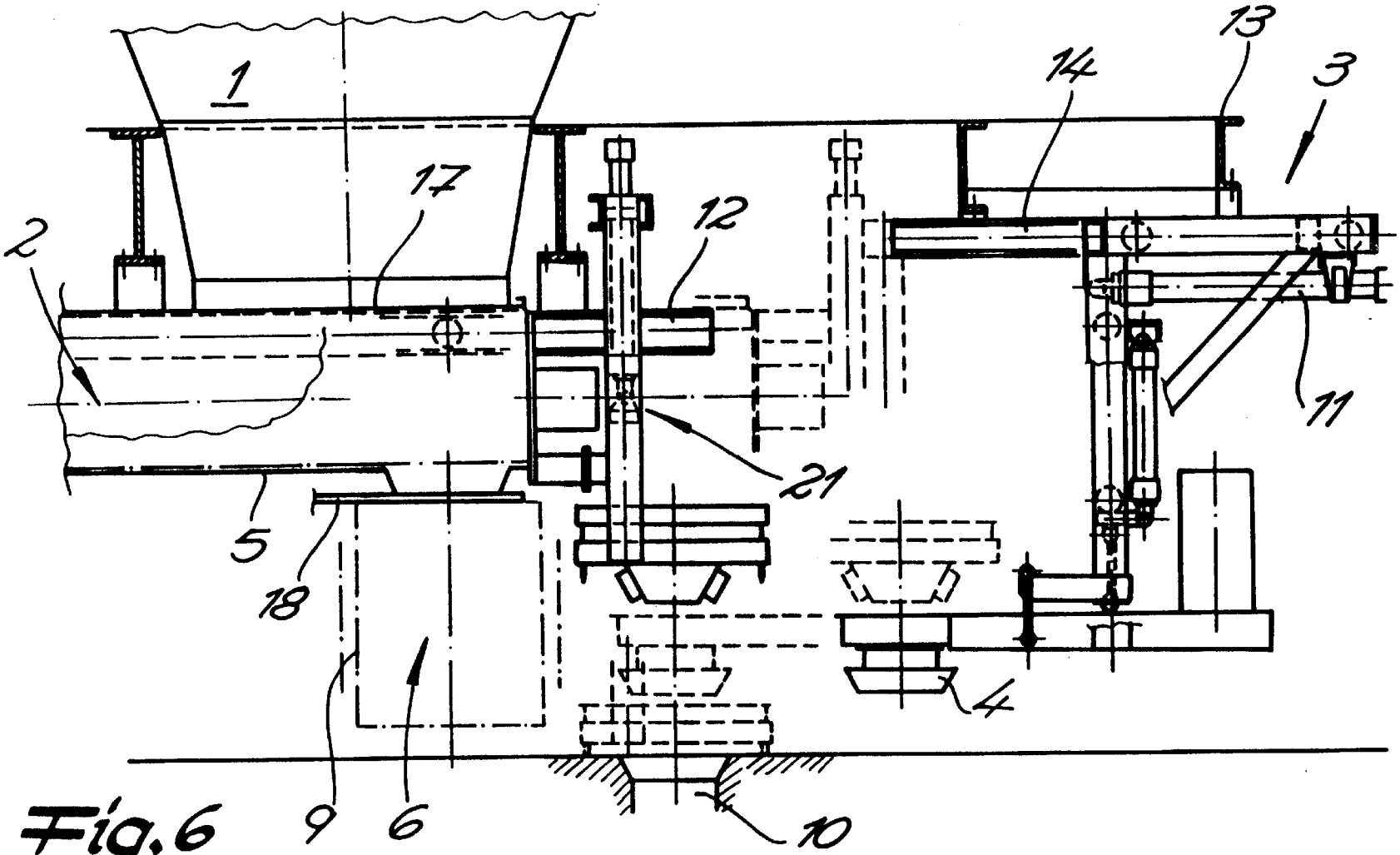
FIG. 6 is a sectional view of another embodiment.

The coal charging car design shown in FIG. 6 has a vertically adjustable device 21 for cleaning the charging hole lid and rim, said device being situated on the same end of the feeder housing 5 as the outlet nozzle 6. The device 21 can travel horizontally with the housing 5 between the housings starting position and its charging position and can be deposited on the charging hole rim 10 when the housing is in its starting position. The lid-lifting device 3 can travel in a horizontal direction independent of the horizontal motion of the feeder housing 5.

The various operational positions adopted by the device 21 are shown in FIG. 6, some of which being represented as dotted lines. The housing 5 of the screw-type feeder 2 takes up its starting position. The charging hole lid 14 is picked up by the lid-lifting device 3 and is then positioned to the side of the charging hole. The device 21 for cleaning the charging hole lid and rim is lowered from its raised position (represented by the continuous line) on to the charging hole rim which it then cleans. The lid-lifting device 3 moves into the position represented by dotted lines and lowers the charging hole lid 4 into the cleaning device 21. Once the cleaning operations have been completed, the lid-lifting device 3 and the cleaning device 21 move back to the positions represented by continuous lines. The screw-type feeder 2 can then be moved into its charging position and the coal charging operations previously described can be initiated.

We claim:

1. A coal charging car for a coke-oven battery, comprising:

a chassis displaceable along a path for successively positioning said car at successive charging holes of chambers of said coke-oven battery;

a bin on said chassis having a funnel-shaped outlet for coal to be discharged into said chambers;

a horizontal screw-type feeder below said bin on said chassis having a housing open upwardly to receive coal from said it outlet, said housing being guided on said chassis for horizontal movement relative to said chassis, said housing having an outlet nozzle alignable with said holes for discharging coal into said holes;

a telescoping pipe connected to said outlet nozzle for bridging between said outlet nozzle and the respective charging hole;

a lid-lifting device on said chassis for lifting lids of said charging holes and replacing lids on said charging holes; and positioning means on said chassis engaged with said housing for shifting said feeder from a starting position wherein the outlet nozzle is offset to a side of a selected charging hole into a charging position wherein said outlet nozzle is substantially aligned with said selected charging hole without altering a position of said chassis with respect to said selected charging hole.

2. The coal charging car defined in claim 1 wherein said screw-type feeder has a cover plate on an upper side thereof blocking said outlet in a starting position of said screw-type feeder relative to the chassis so that coal cannot flow onto a roof of the chambers.

3. The coal charging car defined in claim 1, further comprising a shut off device in said nozzle, and means attached to the screw type feeder for operating said device.

4. The coal charging car defined in claim 1, further comprising means for automatically raising and lowering said telescoping pipe with respect to said outlet nozzle.

5. The coal charging car defined in claim 1 wherein said chassis has guide rails on opposite sides of said housing of said feeder and said housing has means riding along said guide rails.

6. The coal charging car defined in claim 5, further comprising other rails on said chassis parallel to said guide rails, said lid lifting device travelling on said other rails, said positioning means including means positively coupling the motion of said screw-type feeder with the motion of the lid lifting device along the respective rails.

7. The coal charging car defined in claim 6, further comprising a hydraulic or electromechanical actuator attached to said chassis and acting on a coupling beam attached to said housing of the screw-type conveyer, the lid-lifting device being connected to said coupling beam by a rod.

8. The coal charging car defined in claim 1, further comprising a vertically adjustable cleaning device for cleaning the charging hole lid and rim and attached to said housing at the same end thereof as the outlet nozzle, said cleaning device travelling horizontally with the housing relative to the chassis and being positioned at the rim of the charging hole when the housing is in a starting position.

* * * * *